US007344424B2

(12) United States Patent
Ozaki et al.

(10) Patent No.: US 7,344,424 B2
(45) Date of Patent: Mar. 18, 2008

(54) WATER-JET PROPULSION PERSONAL WATERCRAFT

(75) Inventors: Atsufumi Ozaki, Kobe (JP); Keiji Takahashi, Akashi (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 341 days.

(21) Appl. No.: 11/055,586

(22) Filed: Feb. 9, 2005

(65) Prior Publication Data

US 2005/0172919 A1 Aug. 11, 2005

(30) Foreign Application Priority Data

Feb. 9, 2004 (JP) ..... 2004-032257
Apr. 13, 2004 (JP) ..... 2004-117519

(51) Int. Cl.
*B63B 35/73* (2006.01)

(52) U.S. Cl. ..... 440/88 A

(58) Field of Classification Search ..... 440/88 HE, 440/88 C, 88 D, 88 G, 88 J; 123/559.1, 123/563
See application file for complete search history.

(56) References Cited

U.S. PATENT DOCUMENTS 1,795,670 A * 3/1931 Odell et al. ..... 123/3
2,292,233 A * 8/1942 Lysholm ..... 123/559.1
4,422,295 A * 12/1983 Minami et al. ..... 60/605.3
4,562,697 A * 1/1986 Lawson ..... 60/599
5,113,173 A * 5/1992 Lawson ..... 340/449
5,261,356 A * 11/1993 Takahashi et al. ..... 123/41.31
5,911,211 A * 6/1999 Uchida ..... 123/559.1
6,415,759 B2 * 7/2002 Ohrnberger et al. .... 123/195 A
6,666,737 B1 * 12/2003 Matsuo ..... 440/39
7,077,113 B2 * 7/2006 Bilek et al. ..... 123/563

FOREIGN PATENT DOCUMENTS

JP 2001-146197 5/2001

* cited by examiner

*Primary Examiner*—Ed Swinehart
(74) *Attorney, Agent, or Firm*—Alleman Hall McCoy Russell & Tuttle LLP

(57) ABSTRACT

A water-jet propulsion personal watercraft is disclosed, including a multiple-cylinder engine mounted in a body of the watercraft and configured to drive a water jet pump configured to propel the watercraft, and a mechanically driven supercharger configured to supply air taken in from outside to the engine. The engine typically has air-intake ports configured to open toward one side relative to the engine and exhaust ports configured to open toward an opposite side relative to the engine. The supercharger is typically disposed on the one side relative to the engine.

9 Claims, 8 Drawing Sheets

WATER-JET PROPULSION PERSONAL WATERCRAFT

BACKGROUND OF THE INVENTION

1. Field of the Invention

The present invention relates to a water-jet propulsion personal watercraft and, more particularly to a personal watercraft equipped with a supercharger configured to supply air taken in from outside to an engine mounted in the personal watercraft.

2. Description of the Related Art

In recent years, water-jet propulsion personal watercraft have been widely used in leisure, sport, rescue activities, and the like. Generally, personal watercraft are configured to accommodate an engine within an inner space of a body formed by joining a hull and a deck covering the hull from above to each other at their peripheries. The engine is configured to drive a water jet pump, which pressurizes and accelerates water sucked from a water intake generally provided on a hull bottom surface and ejects it rearward from an outlet port. As a result, the personal watercraft is propelled.

The engine is configured to generate a driving force according to the amount of a rider's throttle operation of a throttle lever attached to an upper portion of the deck, thereby gaining a propulsion force to propel the watercraft.

In some personal watercraft, various devices are made to increase the power output of an engine of equal displacement. For example, Japanese Laid-Open Patent Application Publication No. 2001-146197 discloses a personal watercraft equipped with a turbocharger in order to efficiently increase power output from an engine. The turbocharger, which is one type of forced induction system, includes a built-in turbine that rotates under influence of the flow of an exhaust gas, pressurizes air taken in from outside, and supplies the pressurized air to the engine. Since the turbocharger can increase the amount of air supplied to the engine, a higher power is gained in the engine.

The turbocharger can increase a boost pressure of the taken-in air by a faster flow of the exhaust gas for rotating the turbine. Accordingly, personal watercraft equipped with a turbocharger are typically constructed such that the turbocharger is positioned in the vicinity of an exhaust port of the engine to supply the faster flow of the exhaust gas to the turbine. This configuration is exhibited by the the personal watercraft disclosed in the publication No. 2001-146197.

Since the built-in turbine in the turbocharger rotates by the flow of the exhaust gas, an effect peculiar to turbochargers, referred to as "turbo lag," takes place. Undesirably, turbo lag tends to cause a slow response in the change in rotation of the turbine with respect to change in the engine speed of the engine and therefore, tends to cause delay in change in a propulsion force in response to the rider's throttle operation.

In order to reduce an air-intake resistance in an air-intake pipe through which the turbocharger and an air-intake port of the engine communicate with each other, it would be desirable to shorten the length of the air-intake pipe. However, as described above, the turbocharger is positioned in the vicinity of the exhaust port, and hence relatively distant from the air-intake port. For this reason, the turbocharger and the air-intake port communicate with each other through a relative long air-intake pipe, which makes it difficult to reduce the air-intake resistance in the air-intake pipe.

SUMMARY OF THE INVENTION

The present invention addresses the above described conditions, and an object of the present invention is to provide a personal watercraft in which a mechanically driven supercharger is mounted and designed to be positioned to eliminate delay in a response to a rider's throttle operation and to reduce a flow resistance of air that is taken in from outside and supercharged by the supercharger, thereby increasing air-intake efficiency.

According to the present invention, there is provided a water-jet propulsion personal watercraft comprising a multiple-cylinder engine mounted in a body of the watercraft and configured to drive a water jet pump configured to propel the watercraft; and a mechanically driven supercharger configured to supply air taken in from outside to the engine, wherein the engine has air-intake ports configured to open toward one side relative to the engine and exhaust ports configured to open toward an opposite side relative to the engine, and wherein the supercharger is disposed on the one side relative to the engine.

The personal watercraft equipped with the mechanically driven supercharger, such as Roots blower type supercharger or Lysholm compressor type supercharger, can improve operation while ensuring high power output from the engine, since delay in the response to the rider's throttle operation is less likely to occur.

In the above-described construction, since the supercharger is disposed in the vicinity of the air-intake ports, it is possible to reduce the length of the air intake pipes through which the supercharger and the air-intake ports communicate with each other. This makes it possible to inhibit an increase in air-intake resistance of the air flowing through the air-intake pipes. As a result, air-intake efficiency can be improved and a higher power engine is gained. In addition, an air-intake chamber having a large volume which may be disposed in an air-intake system of a naturally aspirated engine (NA engine), can be omitted in the engine equipped with the supercharger. Further, the supercharger is disposed in the vicinity of the air-intake ports rather than the exhaust ports, unlike the turbocharger.

The engine may be constructed such that the cylinders are arranged in a longitudinal direction of the body. The air-intake ports of the cylinders may be configured to open toward one lateral side of the body and the exhaust ports of the cylinders may be configured to open toward an opposite lateral side of the body. Exhaust pipes may be respectively connected to the exhaust ports. Since components having a relatively large weight are disposed on both sides of the body in such a manner that the supercharger is disposed on the one side of the body, i.e., on the air-intake port side of the engine and the exhaust pipes such as an exhaust manifold is disposed on the opposite side of the body, i.e., air exhaust side, the body is stabilized.

The supercharger may have a rotor shaft configured to be coupled rotatably in association with a camshaft provided in a cylinder head of the engine. The supercharger is mounted in the vicinity of the air-intake ports to be relatively distant from the crankshaft and closer to the cylinder head. In this construction, the camshaft may be coupled rotatably in association with the rotor shaft of the supercharger through a belt or a chain, or by a gear train of gears mounted on these shafts.

The supercharger may have a rotor shaft configured to be coupled rotatably in association with a crankshaft of the engine by a pulley mounted on the rotor shaft and a pulley mounted on an output end portion of the crankshaft.

The water-jet propulsion personal watercraft may further comprise an intercooler interposed between the air-intake ports and the supercharger and configured to cool the air supplied from the supercharger to the engine. Since the large air-intake chamber may be omitted in the engine equipped with the supercharger as described above, a free space is formed in the body. In this free space, the intercooler can be disposed as well as the supercharger. Since the intercooler can cool the taken-in air, air-intake efficiency can be further improved.

The engine and the intercooler may have a cooling system configured to cool the engine and the intercooler using cooling water. The cooling system may have a cooling water passage configured to flow the water so as to cool the intercooler and then the engine. Since the cooling water is supplied to the intercooler before the engine, the intercooler can be sufficiently cooled by the cooling water having a relatively low temperature, and the cooling water that is pre-heated by heat exchange with the air in the intercooler is supplied to the engine to appropriately cool the cylinders, thus inhibiting the cylinders from being excessively cooled.

The cooling system may be an open-loop cooling system configured such that the water is taken in by the water jet pump from outside into the body for use as the cooling water to cool the intercooler and the engine, and is thereafter discharged outside the watercraft.

The supercharger may be coupled to the air-intake ports of the engine through an air-intake pipe structured such that one end portion thereof is connected to the air-intake ports of the engine and an opposite end portion thereof forms a housing configured to house the rotor of the supercharger. Since the air-intake pipe is integral with the supercharger, the number of auxiliary components of the engine can be reduced.

The opposite end portion of the air-intake pipe may have a first chamber configured to form an internal space of the housing of the supercharger, and a second chamber located downstream of the first chamber in the flow of the taken-in air and configured to temporarily store the air that is sent out from the supercharger. In such a construction, the supercharger and the air-intake chamber become compact.

The supercharger may be coupled to the air-intake ports of the engine through an air-intake pipe, and a water jacket may be formed in an outer wall portion of the air-intake pipe to allow the cooling water to flow therethrough. In this structure, the air which has been supercharged by the supercharger can be cooled by the cooling water flowing through the water jacket, without a need for an independently provided intercooler.

The above and further objects and features of the invention will more fully be apparent from the following detailed description with accompanying drawings.

DETAILED DESCRIPTION OF THE PREFERRED EMBODIMENTS

Figure 1:
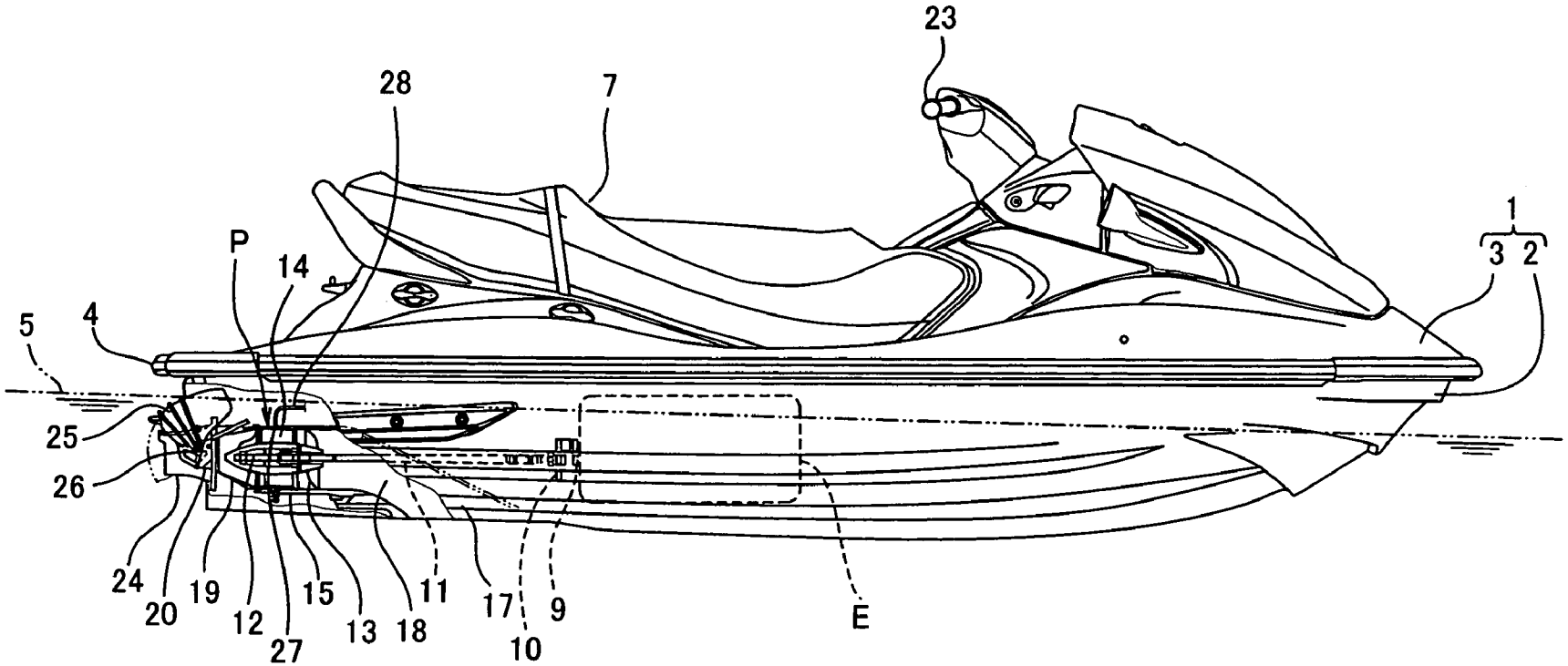
FIG. 1 is a side view of a personal watercraft according to an embodiment of the present invention.

Hereinafter, a personal watercraft according to an embodiment of the present invention will be described with reference to the drawings. The personal watercraft of FIG. 1 is a straddle-type personal watercraft equipped with a straddle-type seat 7 configured to be straddled by a rider. A body 1 of the watercraft is formed by a hull 2 and a deck 3 covering the hull 2 from above. A line at which the hull 2 and the deck 3 are connected over the entire perimeter thereof is called a gunnel line 4. The gunnel line 4 is located above a waterline 5 of the personal watercraft being at rest on the water. Herein, directions are described as seen from the perspective of the rider straddling the seat 7, and looking ahead over the bow of the watercraft. The term "longitudinal direction" is used to refer to an orientation extending from bow to stem of the watercraft, while the term "lateral direction" is used to refer to an orientation extending from starboard to port of the watercraft.

Figure 2:
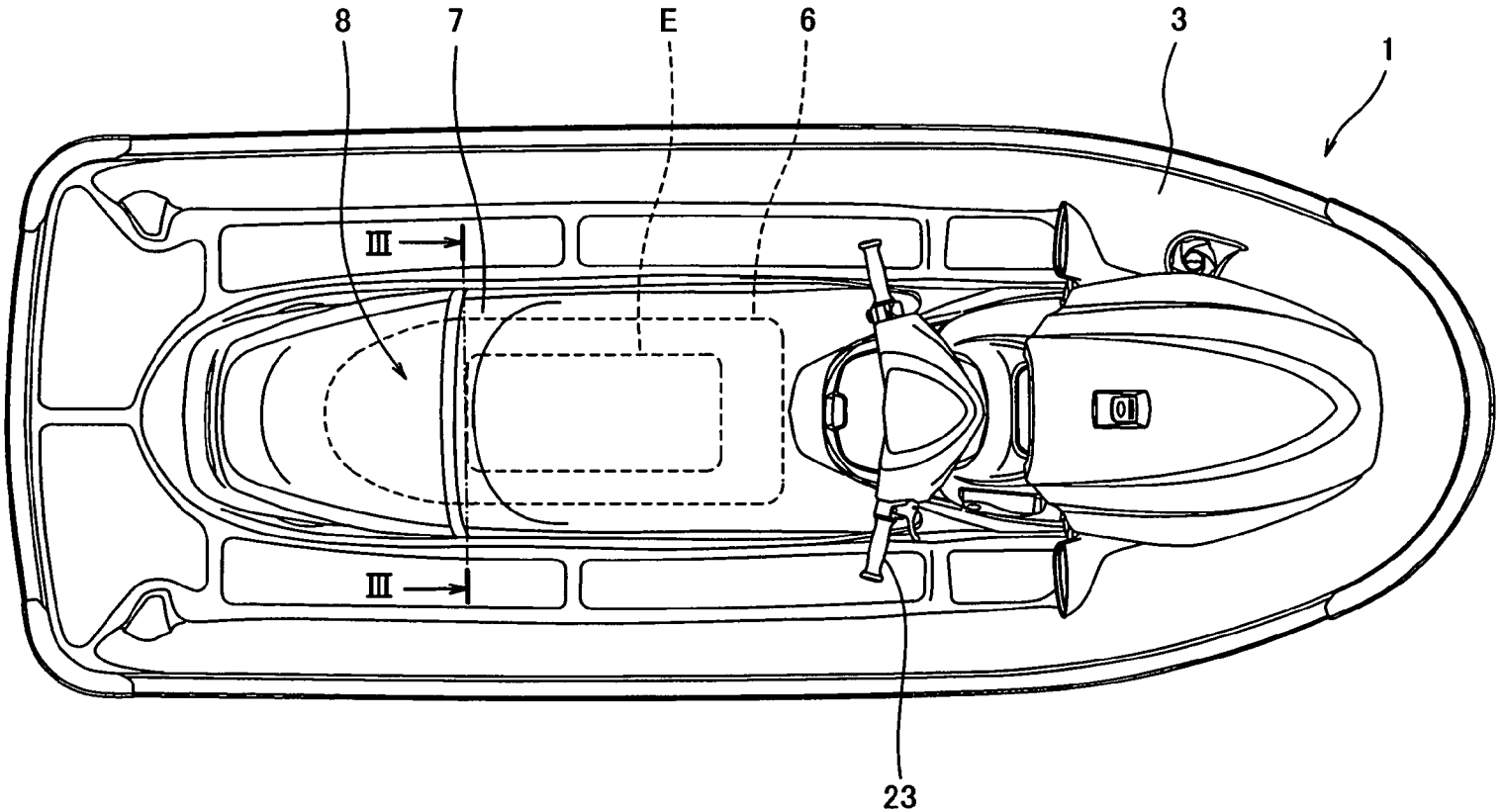
FIG. 2 is a plan view of the personal watercraft of FIG. 1.

As shown in FIG. 2, a deck opening 6, which has a substantially rectangular shape seen from above, is formed on an upper portion of the body 1 at a substantially center section of the deck 3 in the longitudinal and lateral directions of the body 1 to extend in the longitudinal direction of the body 1. The straddle-type seat 7 is removably mounted over the deck opening 6 and configured to be straddled by the rider. An inner space defined by the hull 2 and the deck 3 below the deck opening 6 forms an engine room 8. An engine E is accommodated within the engine room 8 and configured to drive the watercraft. The engine room 8 has a convex-shaped transverse cross-section (see FIG. 3 as described later) and is configured such that its upper portion is smaller than its lower portion.

In this embodiment, the engine E is an in-line four-cylinder four-cycle engine. As shown in FIG. 1, the engine E is disposed such that a crankshaft 9 extends along a longitudinal direction of the body 1. In this construction, as described later with reference to FIG. 4, cylinders 31*a* to 31*d* of the engine E are aligned along the longitudinal direction of the body 1.

As shown in FIG. 1, an output end (rear end) of the crankshaft 9 is integrally and rotatably coupled with a pump shaft 12 of a water jet pump P disposed at a rear portion of the body 1 through a drive shaft 11. An impeller 13 is attached on the pump shaft 12 of the water jet pump P. Fairing vanes 14 are provided behind the impeller 13. The impeller 13 is covered with a pump casing 15 on the outer periphery thereof.

A water intake 17 is provided on the bottom of the body 1. The water intake 17 is connected to the pump casing 15 through a water passage 18. The pump casing 15 is connected to a pump nozzle 19 provided at the rear portion of the body 1. The pump nozzle 19 has a cross-sectional area of flow that is gradually reduced rearward. An outlet port 20 is formed at a rear end of the pump nozzle 19. The drive shaft 11 is configured to penetrate a wall of the water passage 18 and to be exposed inside the body 1 between the engine E and the water passage 18.

The water jet pump P pressurizes and accelerates the water sucked from the water intake 17, and the fairing vanes 14 guide the water. The pressurized and accelerated water is discharged rearward through the pump nozzle 19 and from the outlet port 20, and as the resulting reaction, the watercraft obtains a propulsion force.

As shown in FIGS. 1 and 2, a bar-type steering handle 23 is attached to a front portion of the deck 3. The steering handle 23 is connected to a steering nozzle 24 disposed behind the pump nozzle 19 through a cable (not shown). By operating the steering handle 23 clockwise or counterclockwise, the steering nozzle 24 is pivoted clockwise or counterclockwise. By operating the steering handle 23, the direction of the water ejected outside through the pump nozzle 19 is changed, and the turning direction of the watercraft is changed, while the water jet pump P is generating the propulsion force.

As shown in FIG. 1, a substantially bowl-shaped reverse bucket 25 is positioned at a rear portion of the body 1 and above the steering nozzle 24. The reverse bucket 25 is mounted by a pivot shaft 26 that is horizontally oriented and vertically pivotable around the pivot shaft 26. When the reverse bucket 25 is pivoted downward around the pivot shaft 26 to be positioned behind the steering nozzle 24, the direction of the water ejected rearward from the steering nozzle 24 is directed substantially forward. As a result, the watercraft is propelled rearward.

The engine E mounted in the watercraft has an open-loop cooling system configured to cool the engine E using water taken in from outside as cooling water. To this end, as shown in FIG. 1, a water drawing hole 27 is provided at a predetermined location of an upper portion of the pump casing 15. A cooling water pipe 28 extends from the water drawing hole 27. In this cooling system, the water pressurized by the water jet pump P is drawn from the water drawing hole 27 into the body 1 through the cooling water pipe 28 and supplied to the engine E as the cooling water.

Figure 3:
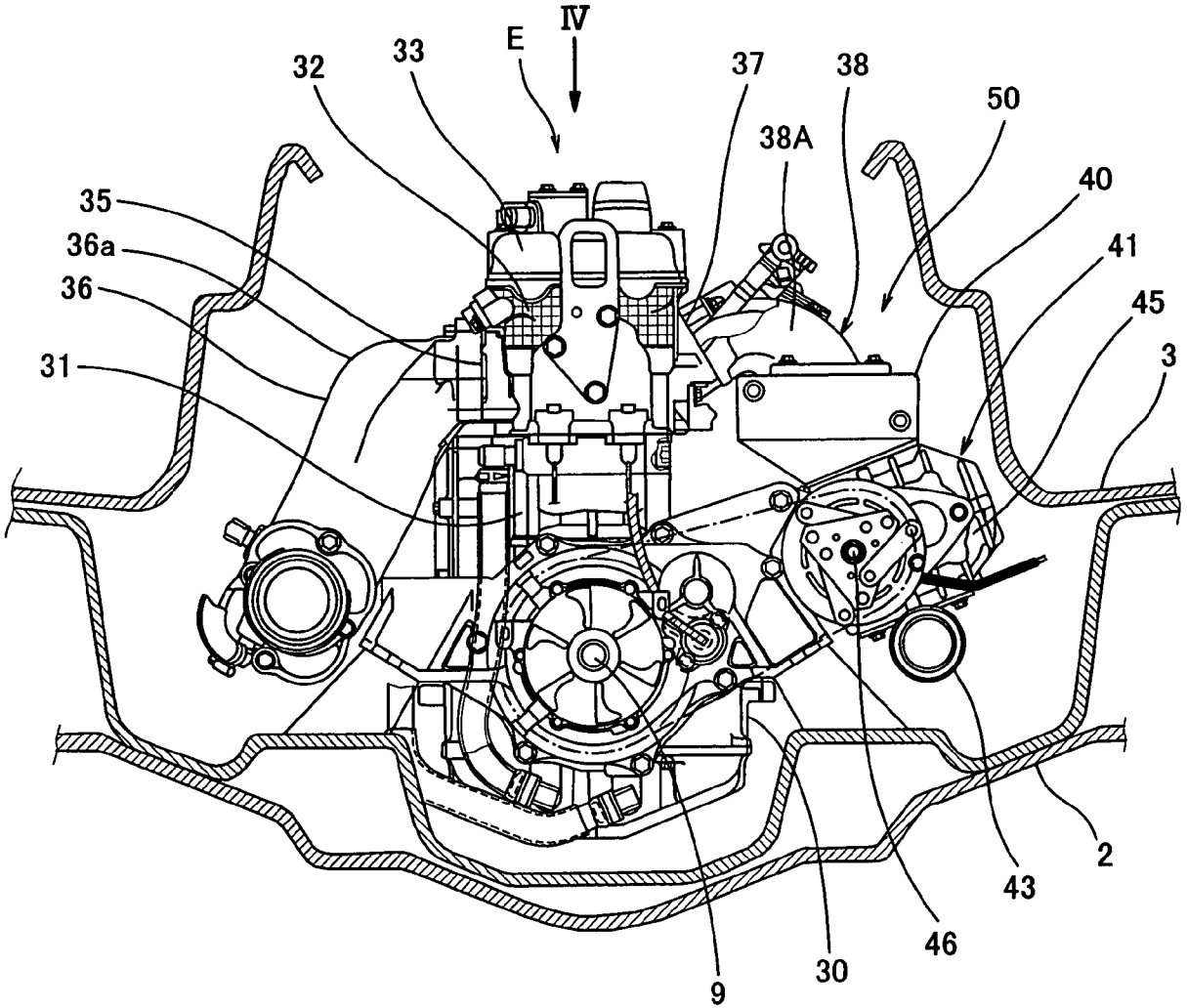
FIG. 3 is a cross-sectional view taken in the direction of arrows substantially along line III-III of the personal watercraft of FIG. 2, showing components mounted in a body of the watercraft, including an engine and air-intake and air-exhaust devices.
Figure 4:
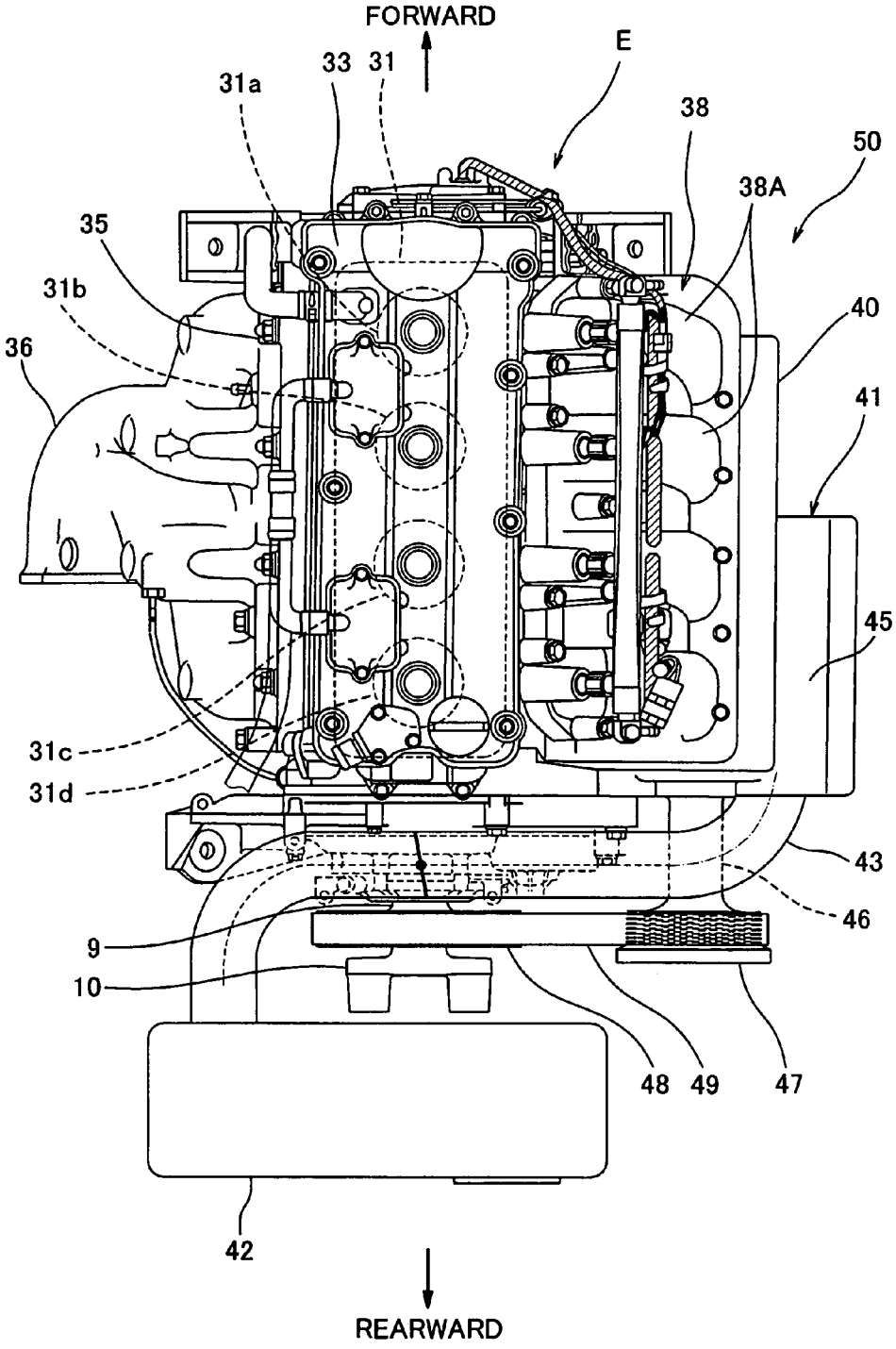
FIG. 4 is a plan view taken in the direction of arrows substantially along line IV of the engine of FIG. 3.

As shown in FIG. 3, the engine E is includes a crankcase 30 that contains the crankshaft 9, a cylinder block 31 located above the crankcase 30 and configured to house a piston (not shown), a cylinder head 32 configured to form a combustion chamber (not shown) along with the cylinder block 31, a head cover 33 provided to cover the cylinder head 32 from above, etc. As described previously, the cylinders 31*a* to 31*d* are aligned in in-line shape within the cylinder block 31 as shown in FIG. 4. The engine E is mounted in the body 1 in such a manner that the cylinders 31*a* to 31*d* are aligned along the longitudinal direction of the body 1.

As shown in FIG. 3, exhaust ports 35 are formed on a left-side portion of the cylinder head 32 to respectively correspond to the cylinders 31*a* to 31*d*. An exhaust manifold 36 is connected to the exhaust ports 35 to extend downward therefrom. More specifically, the exhaust manifold 36 includes four exhaust pipes 36*a* having inner passages merged into one passage on a downstream side in a flow of the exhaust gas. The exhaust pipes 36*a* further include upstream ends that are respectively connected to the exhaust ports 35. In addition, air-intake ports 37 are formed on a right-side portion of the cylinder head 32 to respectively correspond to the cylinders 31*a* to 31*d* and configured to open rightward and upward. One end of an air-intake pipe 38 is branched into four sub-pipes 38A which are connected to the air-intake ports 37. The air-intake pipe 38 extends upward from the air-intake ports 37 and then curves downward. An opposite end of the air-intake pipe 38 is configured to open downward.

An intercooler 40 is positioned laterally and in the vicinity of the air-intake ports 37 and configured to cool air taken in from outside into the engine E. The opposite end of the air-intake pipe 38 is connected to the intercooler 40. The intercooler 40 is of a water-cooling type. As described later, the intercooler 40 is configured to cool the taken-in air using the water drawn into the body 1 through the cooling water pipe 28 (see FIG. 5) connected to the pump casing 15 of the water jet pump P for use as the cooling water.

A supercharger 41 is connected to a lower portion of the intercooler 40. More specifically, the supercharger 41 is positioned in the vicinity of a lower portion of the air-intake ports 37 of the engine E and above the crankshaft 9 in this embodiment. In this structure, the air flows from the supercharger 41 to the air-intake ports 37 through relatively short air-intake passages. The supercharger 41 is of any of mechanically driven types, including the Roots blower type and Lysholm compressor type. In FIG. 3, the supercharger 41 of the Roots blower type is shown. As shown in FIG. 4, an air-intake box 42 is disposed behind the engine E. The supercharger 41 and the air-intake box 42 communicate with each other through an air-intake duct 43.

The supercharger 41 is configured to house a rotor (not shown) within a housing 45. The rotor is configured to rotate with a rotor shaft 46. As shown in FIG. 4, the rotor shaft 46 protrudes rearward outside the housing 45 to extend in parallel with the crankshaft 9. A first pulley 47 is mounted on a rear end portion of the rotor shaft 46. A second pulley 48 is integrally and rotatably mounted on a portion of the crankshaft 9 protruding rearward outside the crankcase 30 and located in front of a coupling means 10. The rotation of the second pulley 48 is transmitted to the first pulley 47 through a belt 49.

The air-intake pipe 38, the intercooler 40, the supercharger 41, the air-intake box 42, and the like form an air-intake system 50. In the air-intake system 50, the crankshaft 9 of the engine E rotates to cause the supercharger 41 to be driven. The air taken into the air-intake box 42 from outside is drawn into the supercharger 41 through the air-intake duct 43 and pressurized by the rotation of the rotor (not shown) within the housing 45. The pressurized air is sent out from the supercharger 41 to the intercooler 40 and cooled therein. The cooled air is supplied into the combustion chamber of the engine E through the air-intake pipe 38 and the air-intake ports 37 (FIG. 3).

In the air-intake system 50, as shown in FIG. 3, since the supercharger 41 is positioned in the vicinity of the lower portion of the air-intake ports 37 and the air-intake pipe 38 extending from the supercharger 41 to the air-intake ports 37 is relatively short, a flow resistance of the pressurized air can be reduced, thus inhibiting reduction of the air-intake efficiency. In addition, since the components having a relatively large weight are disposed on both sides of the engine E in the lateral direction of the body 1 in such a manner that the exhaust manifold 36 is positioned on the left side of the engine E, and the intercooler 40, the supercharger 41, etc are positioned on the right side of the engine E, the weight is well balanced in the lateral direction of the body 1.

Figure 5:
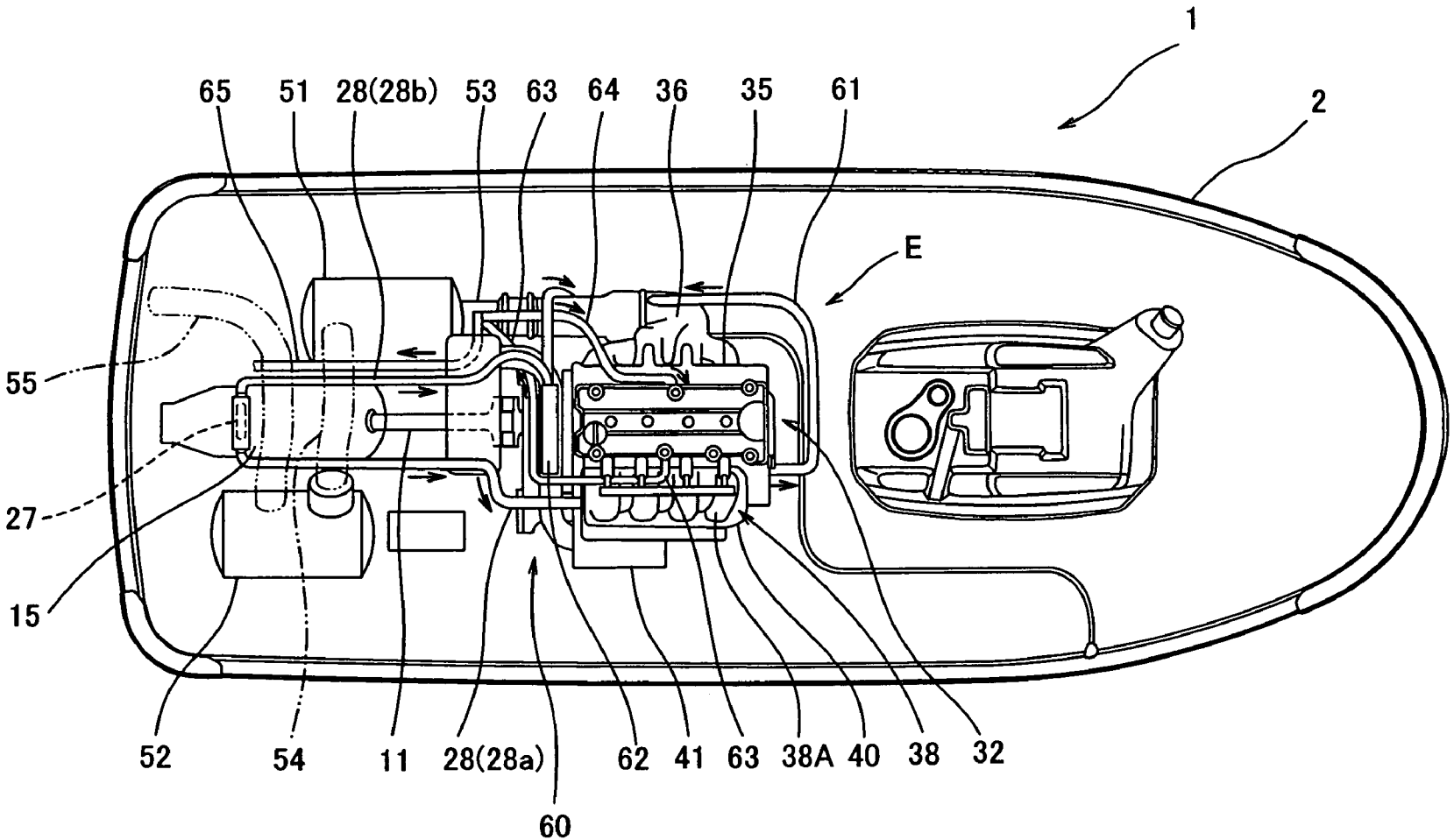
FIG. 5 is a plan view showing a cooling system of the personal watercraft of FIG. 1, with a deck removed from a body of the watercraft.

As shown in FIG. 5, behind the engine E, a first exhaust chamber 51 and a second exhaust chamber 52 are provided on the left side and on the right side of the pump casing 15, respectively. The exhaust manifold 36 extends from the exhaust ports 35 of the engine E and communicates with the first exhaust chamber 51 through a first exhaust pipe 53. The first exhaust chamber 51 communicates with the second exhaust chamber 52 through a second exhaust pipe 54 provided over the pump casing 15 to extend in the lateral direction. The second exhaust chamber 52 communicates with the outside of the watercraft through a third exhaust pipe 55 provided over the pump casing 15 to extend in the lateral direction.

As described previously, the engine E and the intercooler 40 of this embodiment are of the water-cooling type. A cooling system 60 is configured to cool the engine E and the intercooler 40 as follows. The cooling water pipe 28 extends from the water-drawing hole 27 provided on the pump casing 15. The cooling water pipe 28 includes a first cooling water pipe 28*a* and a second cooling water pipe 28*b*. The first cooling water pipe 28*a* extends forward from the water drawing hole 27 and through the right side of the pump casing 15 and is connected to a rear portion of the intercooler 40. The intercooler 40 contains a cooling water passage (not shown). The cooling water drawn through the first cooling water passage 28*a* flows through the cooling water passage of the intercooler 40.

One end portion of a third cooling water pipe 61 is connected to a front portion of the intercooler 40 so as to communicate with the cooling water passage of the intercooler 40. The third cooling water pipe 61 extends to the left through the front side of the engine E, and an opposite end thereof is connected to the exhaust manifold 36. A cooling water passage (not shown) is formed in a wall portion of the exhaust manifold 36. The third cooling water pipe 61 communicates with the cooling water passage of the exhaust manifold 36.

The second cooling water pipe 28*b* extends forward from the water drawing hole 27 and through the left side of the pump casing 15. The second cooling water pipe 28*b* extends through an oil cooler 62 (or another auxiliary device such as a generator) disposed behind the engine E and further to the left side of the engine E and is connected to the exhaust manifold 36. The second cooling water pipe 28*b* also communicates with the cooling water passage formed in the wall of the exhaust manifold 36.

A cooling water passage (water jacket) is formed in the cylinder head 32 to extend from an exhaust port side to an air-intake port side. This cooling water passage communicates with the cooling water passage (water jacket) formed in the exhaust manifold 36 through a connecting face between the cylinder head 32 and the exhaust manifold 36. In addition, a cooling water passage (water jacket not shown) is formed in the cylinder block 31. This cooling water passage communicates with the cooling water passage of the cylinder head 32 through a connecting face between the cylinder block 31 and the cylinder head 32.

One end portion of a fourth cooling water pipe 63 is connected to a wall portion of the cylinder head 32 on the air-intake port side. An opposite end portion of the fourth cooling water pipe 63 is connected to a peripheral wall portion of the first exhaust pipe 53 connecting the exhaust manifold 36 to the first exhaust chamber 51. In this structure, the fourth cooling water pipe 63 communicates with the cooling water passage of the cylinder head 32 at one end portion thereof and communicates with a water jacket formed in the first exhaust pipe 53 at an opposite end portion thereof.

Further, a fifth cooling water pipe 64 and a sixth cooling water pipe 65 extend from the opposite end portion of the fourth cooling water pipe 63. The fifth cooling water pipe 64 is connected to the wall portion of the cylinder block 31 on the exhaust port side and communicates with the cooling water passage of the cylinder block 31. The sixth cooling water pipe 65 extends rearward through the left side of the pump casing 15 and communicates with the outside of the watercraft.

Figure 6:
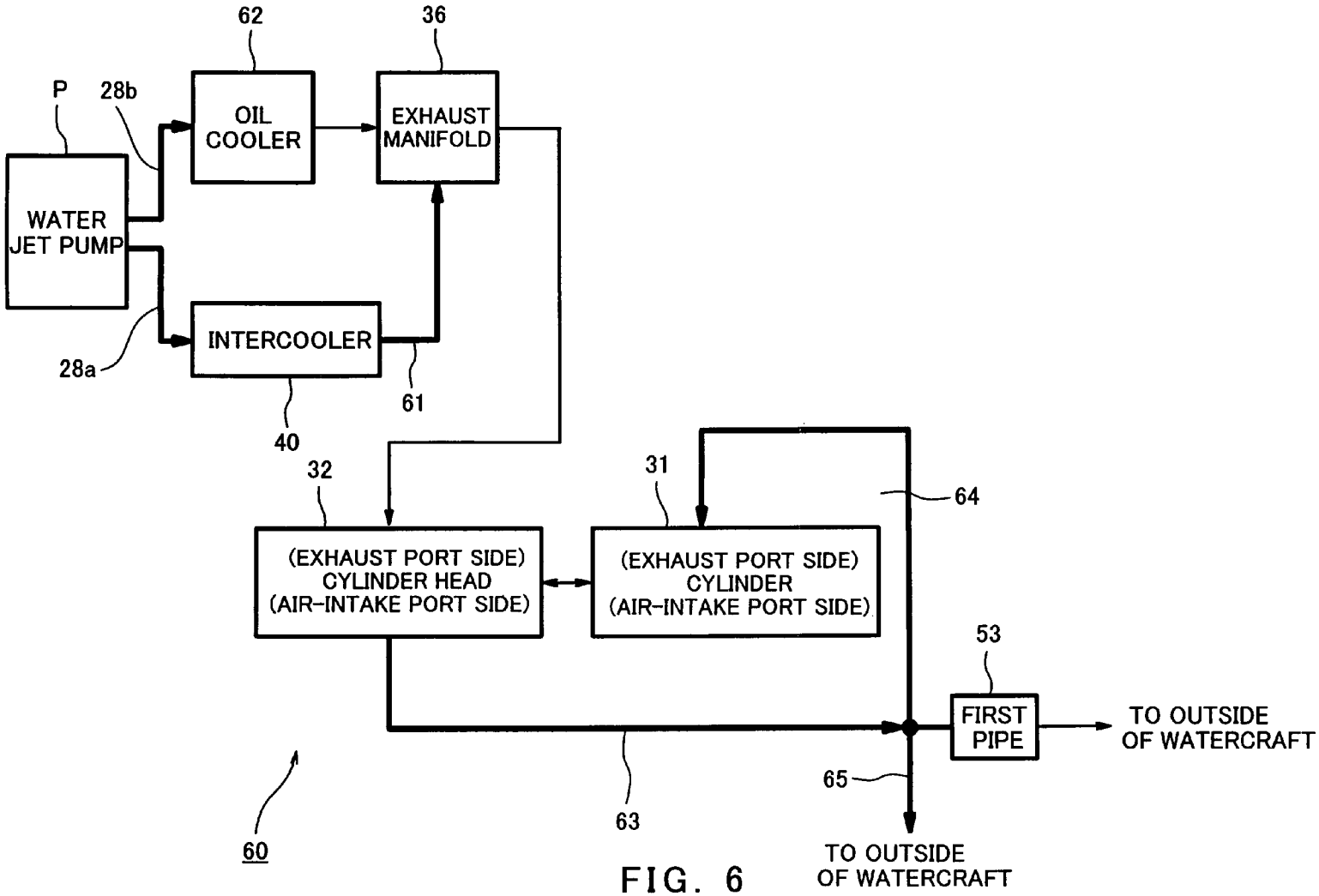
FIG. 6 is a block diagram showing a flow of cooling water in a cooling system of FIG. 5.

Referring to a block diagram of FIG. 6, the water is taken in from the water jet pump P and is supplied to the intercooler 40 through the first cooling water pipe 28*a* for use as the cooling water to cool the taken-in air, which has been pressurized in, and supplied from, the supercharger 41 (see FIGS. 3 to 5) to the intercooler 40. It will be appreciated that, since the cooling water is first supplied to the intercooler 40, the taken-in air in the intercooler 40 can be cooled effectively using cooling water having a relatively low temperature.

The cooling water which has cooled the taken-in air in the intercooler 40 is supplied to the exhaust manifold 36 through the third cooling water pipe 61 to cool the exhaust gas flowing within the exhaust manifold 36.

Meanwhile, the water is taken in from the water jet pump P and is supplied to the oil cooler 62 through the second cooling water pipe 28*b* to cool an oil therein. Thereafter, the water flows into the exhaust manifold 36 and is mixed with the water flowing from the intercooler 40 into the exhaust manifold 36 through the third cooling water pipe 61. The cooling water which has cooled the exhaust gas in the exhaust manifold 36 flows into the cooling water passage formed in the cylinder head 32 and then into the cooling water passage formed in the cylinder block 31 to cool a region around the combustion chamber of the cylinder head 32 and the cylinder block 31.

As should be appreciated, since the cooling water supplied to the cylinder head 32 and the cylinder block 31 through the exhaust manifold 36 has been pre-heated by heat exchange with the taken-in air in the intercooler 40 and with the exhaust gas in the exhaust manifold 36 and hence has an appropriate temperature condition, it is possible to inhibit the cylinder block 31 and the cylinder head 32 from being undesirably excessively cooled.

The cooling water which has cooled the cylinder head 32 and the cylinder block 31 flows through the fourth cooling water pipe 63. Some of this cooling water is supplied to the first exhaust pipe 53. Some of this cooling water is supplied to the cooling water passage of the cylinder block 31 through the fifth cooling water pipe 64 to re-cool the cylinder block 31 and the cylinder head 32. Some of this cooling water is discharged outside the watercraft through the sixth cooling water pipe 65. The cooling water supplied to the first exhaust pipe 53 is discharged outside the watercraft along with the exhaust gas through the first exhaust chamber 51 (FIG. 5) and the second exhaust chamber 52 (FIG. 5) while lowering the energy of the exhaust gas.

The construction of the engine E is not intended to be limited to that of FIG. 3. Hereinbelow, an alternative construction of the engine E will be described with reference to FIGS. 7 and 8. As in the engine E of FIG. 3, an engine E1 of FIG. 7 includes the crankcase 30 configured to house the crankshaft 9, the cylinder block 31 provided above the crankcase 30, the cylinder head 32 provided above the cylinder block 31, and the head cover 33 provided to cover the cylinder head 32 from above.

The air-intake ports 37 are formed on the right-side portion of the cylinder head 32 and configured to open rightward and upward. A downstream portion (one end portion) 71 of air-intake pipe 70 is branched into four sub-pipes 70A which are connected to the air-intake ports 37. The four sub-pipes 70A have similar configuration to the four sub-pipes 38A (see FIGS. 3-5). The air-intake pipe 70 extends rightward and upward from the air-intake ports 37 and then curves downward. An air-intake chamber 73 (FIG. 8) and a supercharger 80 of Roots blower type are provided on an upstream portion (opposite end portion) 72 of the air-intake pipe 70.

Figure 8:
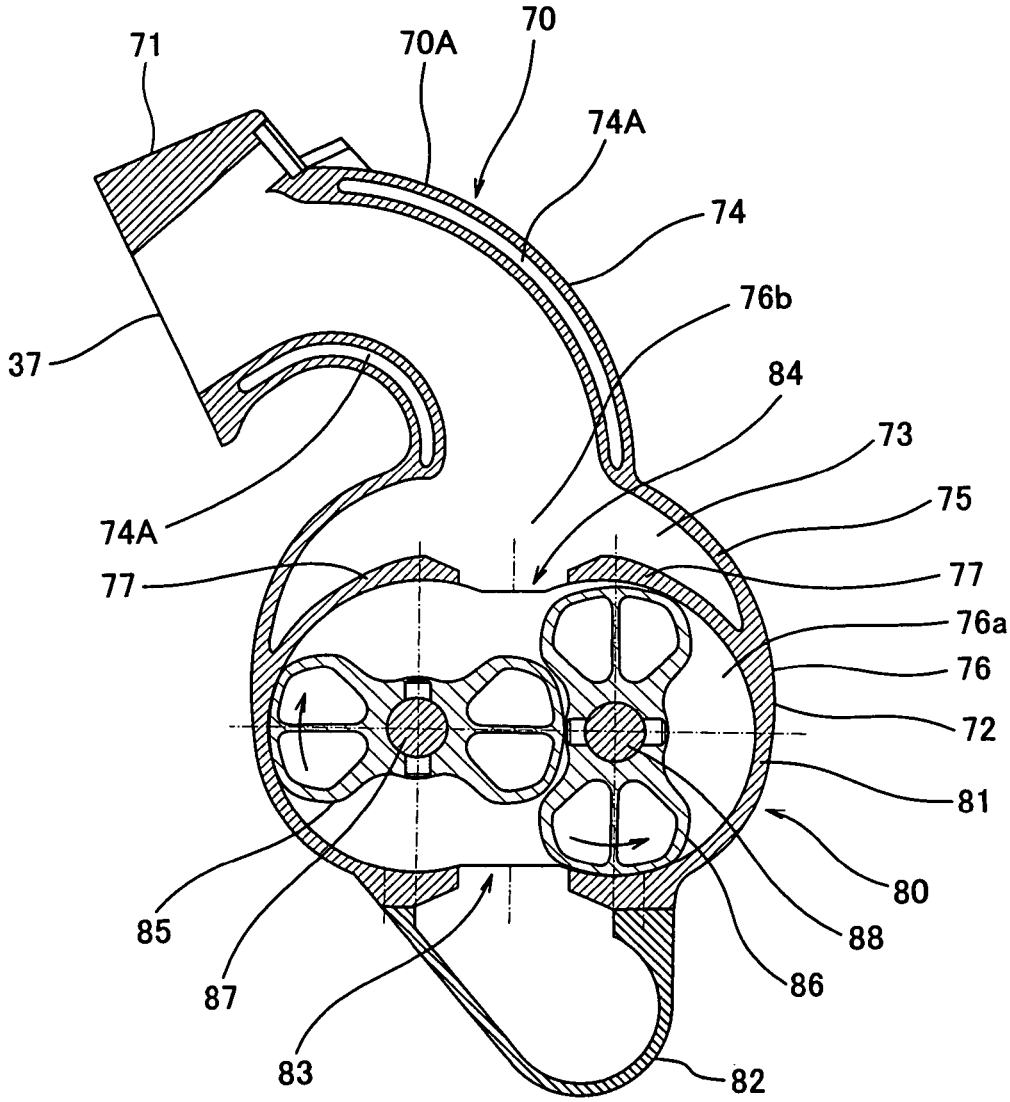
FIG. 8 is a rear cross-sectional view showing a supercharger and an air-intake pipe of FIG. 7.

As shown in FIG. 8, which illustrates the cross-sectional shapes of the air-intake pipe 70 and the supercharger 80, the downstream portion 71 of the air intake pipe 70 which is located downstream of the air-intake chamber 73 has a double-walled structure forming a water jacket 74 having a passage 74A through which the cooling water flows. The water is taken in as the cooling water from outside by the water jet pump P and drawn into the body 1 of the watercraft through the first cooling water pipe 28*a* (see FIG. 5) to be supplied to the water jacket 74. Thereafter, the cooling water flows through the water jacket 74, instead of the intercooler 40 described above, and to the exhaust manifold 36, the cylinder head 32 and the cylinder block 31, etc., in the manner shown in FIG. 6.

A chamber wall 75 of the air-intake chamber 73 and a housing 81 of the supercharger 80 are formed integrally with the upstream portion 72 of the air-intake pipe 70. More specifically, the air-intake pipe 70 extends from the air intake ports 37 and has the upstream portion 72 having an enlarged diameter to form an enlarged-diameter wall portion 76 having a cross-section of substantially an oval shape as viewed from the rear. The enlarged-diameter wall portion 76 has a space including a first chamber 76*a* on a lower side and a second chamber 76*b* on an upper side, which are defined by a separating wall 77. The first chamber 76*a* is located upstream, and the second chamber 76*b* is located downstream in the flow of the taken-in air.

More specifically, an upper half portion of the enlarged-diameter wall portion 76 and the separating wall 77 form the air-intake chamber 73, which contains the second chamber 76*b* having a predetermined volume. A lower half portion of the enlarged-diameter wall portion 76 and the separating wall 77 form the housing 81 of the supercharger 80 which contains the first chamber 76*a* having a predetermined volume. The housing 81 has an elongated-circle shaped cross-section with its long axis horizontally oriented, as viewed from the rear. One opening end portion of the air-intake duct 82 is connected to an outer wall of a lower portion of the housing 81. An opposite end portion of the air-intake duct 82 is connected to an air-intake box (not shown).

An air-intake inlet 83 of the supercharger 80 is formed on a lower wall portion of the housing 81. The interior of the housing 81, i.e., the first chamber 76*a*, and the interior of the air-intake duct 82 communicate with each other through the air-intake inlet 83. An air-intake outlet 84 of the supercharger 80 is formed on an upper wall portion of the housing 81, i.e., the separating wall 77, and the interior of the housing 81 and the air-intake chamber 73 communicate with each other through the air-intake outlet 84. In this structure, the air drawn from the air-intake box is supplied to a combustion chamber (not shown) of the engine E1 through the air-intake duct 82, the supercharger 80 and the air-intake chamber 73 corresponding to the upstream portion 72 of the air-intake pipe 70, and the downstream portion 71 of the air-intake pipe 70 which is provided with the water jacket 74.

Figure 7:
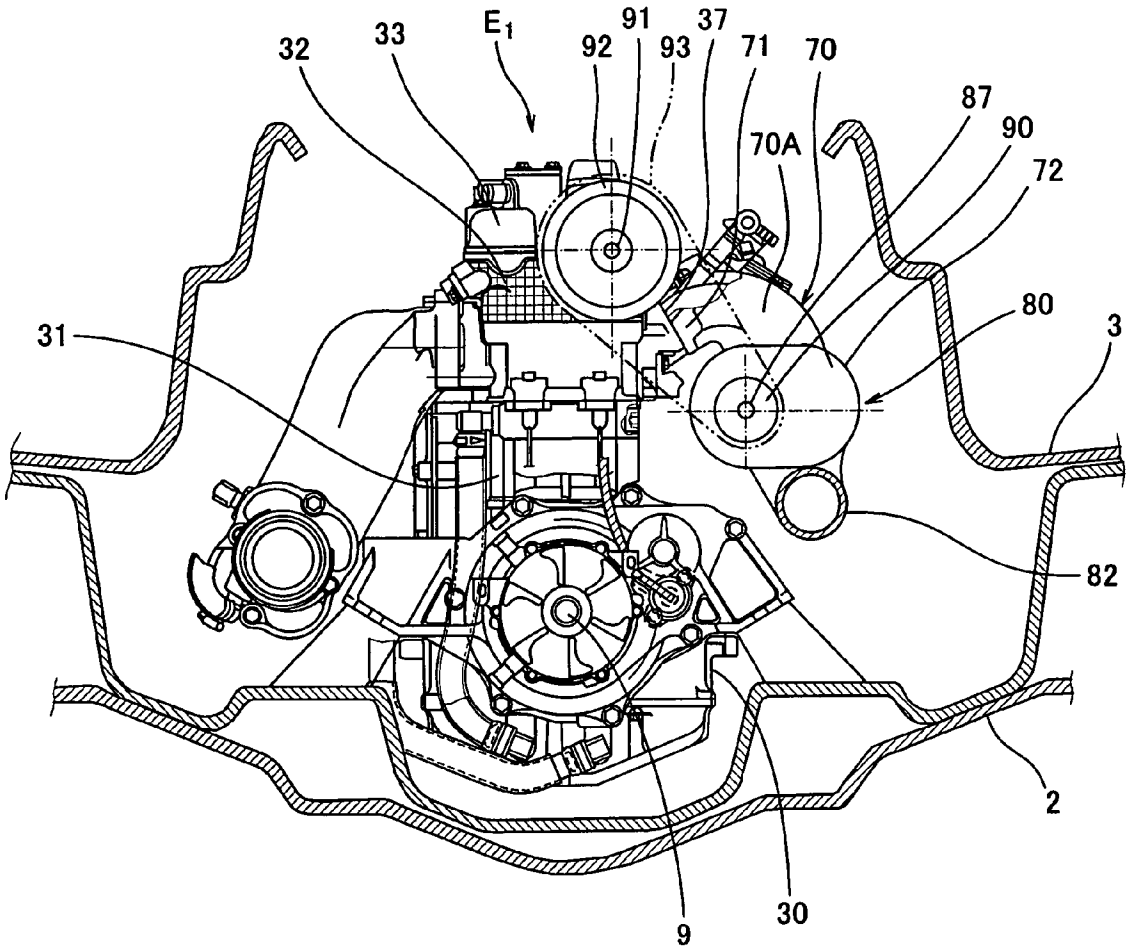
FIG. 7 is a cross-sectional view taken in the direction of arrows substantially along line III-III of FIG. 2, showing a construction different from that of FIG. 3, regarding the engine and the air-intake and air-exhaust devices mounted in the body.

A driving rotor 85 and a driven rotor 86 are housed on the left side and the right side within the housing 81, i.e., the first chamber 76*a*. The driving rotor 85 and the driven rotor 86 are mounted to rotor shafts 87 and 88 with center axes oriented in the longitudinal direction of the body 1. As shown in FIG. 7, the rotor shaft 87 to which the driving rotor 85 is mounted has a rear end portion protruding rearward from the housing 80, and a first pulley 90 is mounted on the rear end portion of the rotor shaft 87. A rear end portion of a camshaft 91 on the air-intake port side which is housed in the head cover 33 of the engine E1 protrudes rearward from the head cover 33 and a second pulley 92 is mounted on the rear end portion of the camshaft 91. A belt 93 is installed around the first and the second pulleys 90 and 92 to connect them. In this embodiment, the first pulley 90 has a diameter half as large as that of the second pulley 92.

In the personal watercraft constructed as described above, when the engine El drives to cause the camshaft 91 to rotate, the rotation of the camshaft 91 is transmitted to the rotor shaft 87 via the first and second pulleys 90 and 92 and the belt 93 such that the number of rotations of the rotor shaft 87 becomes twice as many as that of the camshaft 91, thereby causing the driving rotor 85 and the driven rotor 86 to rotate. As a result, the taken-in air drawn into the housing 81 through the air-intake inlet 83 is supercharged by the driving rotor 85 and the driven rotor 86 within the housing 81, and the resulting supercharged air is sent out under pressure from the air-intake outlet 84 of the supercharger 80 to the air-intake ports 37, through which the air is supplied to the combustion chamber of the engine E1. The first pulley 90 may be configured to be driven by the pulley mounted on the crankshaft 9 as shown in FIG. 3.

While the supercharger 80 and the air-intake chamber 73 are formed integrally within the air-intake pipe 70 in this embodiment, they may alternatively be formed as separate parts which are thereafter connected by a suitable coupling means.

The present invention is applicable to a stand-up type personal watercraft configured to be steered by a rider standing on a deck, as well as the straddle-type personal watercraft equipped with the seat 7.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A water-jet propulsion personal watercraft comprising:

a multiple-cylinder engine which is mounted in a body of the watercraft and is constructed such that cylinders are arranged in a longitudinal direction of the body, the engine being configured to drive a water jet pump configured to propel the watercraft; and a mechanically driven supercharger configured to supply air taken in from outside to the engine;

wherein the engine has air-intake ports configured to open toward one side relative to the engine and toward one lateral side of the body and exhaust ports configured to open toward an opposite side relative to the engine and toward an opposite lateral side of the body;

wherein the supercharger is disposed below the air-intake ports and above a crankshaft when viewed from the side of the engine on the one side relative to the engine such that a rotor shaft of the supercharger is parallel to the crankshaft of the engine; and wherein the rotor shaft of the supercharger is configured to be coupled rotatably in association with a camshaft provided in a cylinder head of the engine via a first pulley mounted to a rear portion thereof, a second pulley mounted to a rear portion of the camshaft, and a belt installed around the first and second pulleys.

2. The water-jet propulsion personal watercraft according to claim 1, wherein the supercharger is coupled to the air-intake ports of the engine through an air-intake pipe which is structured such that one end portion thereof is connected to the air-intake ports of the engine and an opposite end portion thereof forms a housing configured to house a rotor of the supercharger, wherein the air-intake pipe and the supercharger thereby form an integrally formed unitary component.

3. A water-let propulsion personal watercraft comprising:

a multiple-cylinder engine which is mounted in a body of the watercraft and is constructed such that cylinders are arranged in a longitudinal direction of the body, the engine being configured to drive a water jet pump configured to propel the watercraft;

a mechanically driven supercharger configured to supply air taken in from outside to the engine;

wherein the engine has air-intake ports configured to open toward one side relative to the engine and toward one lateral side of the body and exhaust ports configured to open toward an opposite side relative to the engine and toward an opposite lateral side of the body;

wherein the supercharger is disposed below the air-intake ports and above a crankshaft when viewed from the side of the engine on the one side relative to the engine such that a rotor shaft of the supercharger is parallel to the crankshaft of the engine;

wherein the supercharger is coupled to the air-intake ports of the engine through an air-intake pipe which is structured such that one end portion thereof is connected to the air-intake ports of the engine and an opposite end portion thereof forms a housing configured to house a rotor of the supercharger, wherein the air-intake pipe and the supercharger thereby form an integrally formed unitary component; and wherein the opposite end portion of the air-intake pipe is configured to be expanded in a radial direction to form a first chamber configured to form an internal space of the housing of the supercharger, and a second chamber located downstream of the first chamber in the flow of the taken-in air and configured to temporarily store the air that is sent out from the supercharger.

4. The water-jet propulsion personal watercraft according to claim 3, wherein the supercharger is coupled to the air-intake ports of the engine through an air-intake pipe, and a water jacket is formed in an outer wall portion of the air-intake pipe to allow the cooling water to flow therethrough.

5. The water-jet propulsion personal watercraft according to claim 3, wherein the supercharger is disposed below an air-intake pipe extending from the air-intake ports and an exhaust pipe is extending from the exhaust ports.

6. The water-jet propulsion personal watercraft according to claim 3, wherein the rotor shaft of the supercharger is configured to be coupled rotatably in association with a crankshaft of the engine by a first pulley mounted on the rotor shaft and a second pulley mounted on an output end portion of the crankshaft, and a belt installed around the first and second pulleys.

7. The water jet propulsion personal watercraft according to claim 3, further comprising:

an intercooler interposed between the air-intake ports and the supercharger, and configured to cool the air supplied from the supercharger to the engine, wherein the engine and the intercooler have a cooling system configured to cool the engine and the intercooler using cooling water, wherein the cooling system is an open-loop cooling system configured such that the water is taken in by the water jet pump from outside, into the body, for use as the cooling water to cool the intercooler and the engine, and thereafter discharged outside the watercraft.

and wherein the cooling system has a cooling water passage configured to guide water flow so as to cool the intercooler and then cool the engine disposed downstream of the intercooler in a flow direction of the water.

8. The water-jet propulsion personal watercraft according to claim 6, wherein the crankshaft has an output end portion protruding rearward from a crankshaft of the engine, and the second pulley is mounted to the output end portion.

9. The water-jet propulsion personal watercraft according to claim 3, wherein the opposite end portion of the air-intake pipe is provided inside thereof with a separating wall for defining the first chamber and the second chamber, and the separating wall has an opening through which the first chamber and the second chamber communicate with each other.

* * * * *